US005637132A

United States Patent [19]

Matthews et al.

[11] Patent Number: 5,637,132

[45] Date of Patent: *Jun. 10, 1997

[54] POWDER METALLURGY COMPOSITIONS

[75] Inventors: Paul Matthews; Thomas Pelletier, II, both of Flemington, N.J.

[73] Assignee: United States Bronze Powders, Inc., Flemington, N.J.

[ * ] Notice: The term of this patent shall not extend beyond the expiration date of Pat. No. 5,441,555.

[21] Appl. No.: 441,039

[22] Filed: May 15, 1995

Related U.S. Application Data

[63] Continuation of Ser. No. 279,223, Jul. 22, 1994, Pat. No. 5,441,555, which is a continuation of Ser. No. 930,698, filed as PCT/GB91/00351 Mar. 6, 1991, abandoned.

[30] Foreign Application Priority Data

Mar. 6, 1990 [GB] United Kingdom ..... 9005036
Jan. 29, 1991 [GB] United Kingdom ..... 9101829

[51] Int. Cl.[6] ..... C22C 9/04

[52] U.S. Cl. ..... 75/252; 75/255; 420/470; 420/477; 420/499

[58] Field of Search ..... 148/413, 434; 420/477, 499, 470; 75/252, 255

[56] References Cited

U.S. PATENT DOCUMENTS

| | | | |
|---|---|---|---|
| 1,421,471 | 7/1922 | Heskett | 75/255 |
| 2,286,237 | 6/1942 | Shaw et al. | 75/255 |
| 2,467,675 | 4/1949 | Kurtz et al. | 75/255 |
| 3,370,942 | 2/1968 | Inoue | 75/134 |
| 3,790,352 | 2/1974 | Niimi et al. | 75/247 |
| 3,805,000 | 4/1974 | Roy | 200/144 B |
| 3,832,156 | 8/1974 | Wilson et al. | 75/5 B |
| 3,948,652 | 4/1976 | Schreiner et al. | 75/170 |
| 4,014,688 | 3/1977 | Schreiner et al. | 75/123 B |
| 4,014,698 | 3/1977 | Schreiner et al. | 75/129 |
| 4,169,730 | 10/1979 | Matthews et al. | 75/157 |
| 4,172,720 | 10/1979 | Megelas | 75/251 |
| 4,537,743 | 8/1985 | Yamanaka et al. | 419/38 |
| 4,540,437 | 9/1985 | Patel | 75/251 |
| 4,551,395 | 11/1985 | Lloyd | 428/677 |
| 4,708,739 | 11/1987 | Kellie et al. | 75/76 |
| 4,770,723 | 9/1988 | Sagawa et al. | 75/255 |
| 4,834,794 | 5/1989 | Yagi et al. | 75/255 |
| 4,879,094 | 11/1989 | Rushton | 420/476 |
| 4,920,020 | 4/1990 | Strauven et al. | 75/255 |
| 4,981,513 | 1/1991 | Ghandehari | 75/255 |
| 5,137,685 | 8/1992 | McDevitt et al. | 420/499 |
| 5,167,726 | 12/1992 | LoIacono et al. | 420/499 |
| 5,288,458 | 2/1994 | McDevitt et al. | 420/477 |
| 5,354,352 | 10/1994 | Seki et al. | 74/247 |
| 5,441,555 | 8/1995 | Matthews et al. | 75/255 |
| 5,445,665 | 8/1995 | Matthews et al. | 75/255 |
| 5,487,867 | 1/1996 | Singh | 148/413 |

FOREIGN PATENT DOCUMENTS

| | | |
|---|---|---|
| 692687 | 8/1964 | Canada . |
| 0083200 | 12/1982 | European Pat. Off. . |
| 0224619 | 11/1985 | European Pat. Off. . |
| 165872 | 12/1985 | European Pat. Off. . |
| 3829250 | 3/1990 | Germany . |
| 56-142839 | 11/1981 | Japan . |
| 655742 | 4/1979 | U.S.S.R. . |
| 250721 | 2/1925 | United Kingdom . |
| 581903 | 5/1944 | United Kingdom . |
| 615172 | 7/1947 | United Kingdom . |
| 901026 | 5/1958 | United Kingdom . |
| 1000651 | 11/1965 | United Kingdom . |
| 1162573 | 8/1969 | United Kingdom . |
| 1390212 | 4/1975 | United Kingdom . |
| 1518781 | 7/1978 | United Kingdom . |
| 2211206A | 6/1989 | United Kingdom . |

OTHER PUBLICATIONS

Chem. Abstr., vol. 105, No. 10, 83631s (Katsuhiro et al.) Imon, (Japan) 1986, 58(6), 449–454.

Chem. Abstr., vol. 98, No. 24, 202192 (Hitachi Chemical Co.).

Chem. Abstr., vol. 96, No. 16, 128144 (Hitachi Chemical Co.).

"Copper and Copper Alloys: Compositions and Mechanical Properties", Copper Development Association, London, 1964, p. 4.

*Primary Examiner*—George Wyszomierski

*Attorney, Agent, or Firm*—Woodcock Washburn Kurtz Mackiewicz & Norris LLP

[57] ABSTRACT

Lead-free metallurgy powder for use in manufacturing a shaped bronze part by powder metallurgy techniques which consists essentially of a substantially homogeneous blend of metal powders having about 90 parts copper, about 10 parts tin and an amount of bismuth in the range from an amount effective to improve the machinability of the shaped bronze part up to about 5% weight are disclosed. Lead-free metallurgy powder for use in manufacturing a shaped brass part by powder metallurgy techniques which consists essentially of a substantially homogeneous blend of metal powders about 70–90 parts copper, about 10-30 parts zinc and an amount of bismuth in the range from an amount effective to improve the machinability of the shaped brass part up to about 5% weight are also disclosed.

20 Claims, No Drawings

POWDER METALLURGY COMPOSITIONS

CROSS REFERENCE TO RELATED PATENT APPLICATIONS

This application is a Continuation Application of U.S. application Ser. No. 08/279,223 filed Jul. 22, 1994, now U.S. Pat. No. 5,441,555 which is a File Wrapper Continuation Application of U.S. application Ser. No. 07/930,698, filed as PCT/GB91/00351 Mar. 6, 1991, abandoned.

DESCRIPTION

This invention relates to powder metallurgy compositions containing elemental and/or prealloyed non-ferrous metal powders, organic lubricants, and with or without flake graphite additives. For example pre-blended bronze compositions are commonly used for self-lubricating bearings and bushings, oil impregnated bearings for motor use, household appliances, tape recorders, video cassette recorders etc. In commercial powder metallurgy practices, powdered metals are converted into a metal article having virtually any desired shape.

The metal powder is firstly compressed in a die to form a "green" preform or compact having the general shape of the die. The compact is then sintered at an elevated temperature to fuse the individual metal particles together into a sintered metal part having a useful strength and yet still retaining the general shape of the die in which the compact was made. Metal powders utilized in such processes are generally pure metals, OR alloys or blends of these, and sintering will yield a pan having between 60% and 95% of the theoretical density. If particularly high density low porosity is required, then a process such as a hot isostatic pressing will be utilized instead of sintering. Bronze alloys used in such processes comprise a blend of approximately 10% of tin powder and 90% of copper powder and according to one common practice the sintering conditions for the bronze alloy are controlled that a predetermined degree of porosity remains in the sintered part. Such parts can then be impregnated with oil under pressure of vacuum to form a so-called permanently lubricated bearing or component and these parts have found wide application in bearings and motor components in consumer products and eliminate the need for periodic lubrication of these parts during the useful life of the product. Solid lubricants can also be include and these are typically waxes, metallic/non-metallic stearates, graphite, lead alloy, molybdenum disulfide and tungsten disulfide as well as many other additives, but the powders produced for use in powder metallurgy have typically been commercially pure grades of copper powder and tin powder which are then admixed in the desirable quantities.

For many metallurgical purposes, however, the resulting sintered product has to be capable of machined that is to say, it must be capable of being machined without either "tearing" the surface being machined to leave a "rough" surface or without unduly blunting or binding with the tools concerned. It is the common practice for a proportion of lead up to 10% to be included by way of a solid lubricant to aid and improve the machineability of the resulting product.

Lead is, however, a toxic substance and the use of lead in the production of alloys is surrounded by legislation and expensive control procedures. Furthermore, the lead phase in copper lead alloys can be affected by corrosive attacks with hot organic or mineral oil; when the temperature rises of such an alloy rised; for example in service it has been known that the oil can break down to form peroxides and organic gases which effect a degree of leaching on the lead phase within the alloy. If this leaching progresses to any extent, the component if it is a bearing or structural component, may eventually malfunction or fail.

Accordingly. There is considerable advantage in reducing, or if possible, eliminating the contents of lead within powder metallurgy compositions.

According to one aspect of the present invention, therefore, there is provided a powder composition suitable for use in powder metallurgy in which composition the lead content has been substituted by an effective amount of bismuth.

In one aspect of the present invention, the proportion of bismuth is within the range of 35% to 65% of the proportion of lead that it replaces. In a further aspect of the present invention, the powder composition may be bronze powder and the bismuth may be present in an amount of up to 5% by weight.

The bismuth may be present as an elemental powder or may be prealloyed with another constituent of the powder composition, for example, where the powder composition is bronze powder, the bismuth may be prealloyed either with tin as a bismuth tin alloy in powder form or with copper as a copper bismuth alloy in powder form.

In a further aspect of the present invention a proportion of lubricant may be included to improve further the machineability of the resulting alloy. A typical lubricant is graphite which may be included in an amount of 0.1% to 0.9% by weight. Other lubricants are low density polyalkylenes such as that commercially available under the trade name COATHYLENE; stearic acid and zinc stearate which may be included separately or in combination.

In a powder metallurgy bronze powder in accordance with the present invention, lead may be replaced by approximately one half of its quantity of bismuth to obtain the same degree of machineability, i.e. in general terms 2% of bismuth could replace a 4% on the weight of bronze powder of lead.

Investigations have established that bismuth has no known toxicity. Bismuth is non-toxic and its developing or proliferating uses in pharmaceuticals, cancer-reducing therapy, X-ray opaque surgical implants and other medical equipment indicate that bismuth, while not only more efficient in improving the machineability, also has low or nil toxicity.

The present invention also includes products when manufactured by powder metallurgy techniques using the powder in accordance with the present invention.

Following is a description by way of example only of methods of carrying the invention into effect.

EXAMPLE 1

A powder metallurgic bronze powder system comprised 90% of elemental copper powder, 10% of elemental tin powder and 0.75% of lubricant on the weight of the tin and copper. A number of elemental conditions of both bismuth and lead were made in various percentages to the basic composition and the results are set out in Table 1. In order to evaluate the effectiveness of each addition, test specimens were made and underwent a standard drilling test. All reported data from this test is based on an average of multiple drilling tests and is reported in standardised inches per minute. All test specimens were standard MPIF transverse rupture bars pressed to a reported green density. All data in Table 1 reflects test specimens sintered at 1520° F. for a time of 15 minutes under a dissociated ammonia atmosphere (75%$H^2$, 25%$N^2$).

TABLE 1

| Comparative Tests: Drilling Rate (inches/minute) | | | | | |
|---|---|---|---|---|---|
| | | Addition % | | | |
| Elemental | Green Density | 0 | 1 | 3 | 5 |
| Bronze | 6.0 g/cm | 0.9 | — | — | — |
| (No Pb or Bi Additions) | 6.5 g/cm | 1.2 | — | — | — |
| Bronze + Bi | 6.0 g/cm | — | 8.6 | 14.0 | 8.9 |
| | 6.5 g/cm | — | 9.8 | 11.7 | 4.3 |
| Bronze + Pb | 6.0 g/cm | — | 9.5 | 22.2 | 13.0 |
| | 6.5 g/cm | — | 8.2 | 19.0 | 7.7 |

In Table 1 it will be seen that a percentage of 1% of bismuth produces comparable drilling time with the corresponding figures for lead.

EXAMPLE 2

Copper bismuth was prealloyed, atomized and powdered bronze compositions were prepared having the compositions containing 10% tin powder. Sintered test bars were prepared and drilled and the drilling time given is the actual time converted into inches per minute required to drill a 3/16" hole completely through a ¼" thick sintered bar at a constant drill bit speed and drill unit false weight free fall, i.e. no spring retainer or varying physical force.

TABLE 2

| Drilling Rate (inches/minute) vs. Bi % | | | | | | |
|---|---|---|---|---|---|---|
| | % Bi | | | | | |
| Green Density g/cm | 0 | 0.5 | 1.0 | 2.0 | 3.0 | 5.0 |
| 6.0 | 0.9 | 4.2 | 7.9 | 8.2 | * | * |
| 6.5 | 1.2 | 4.1 | 6.6 | 8.2 | * | * |
| 7.5 | 0.2 | — | 8.4 | — | 6.6 | 4.1 |
| 7.9 | ** | — | 8.3 | — | 8.5 | 6.2 |

*: Pre-alloyed Cu/Bi powder physical properties prevented practical compacting of test bars.
**: Standard Copper/Tin powder reference blend could not be practically compacted to 7.9 gm/cm$^3$ density.

It will be seen that the addition of quantities of bismuth produced improvements in the machineability with increasing green density.

EXAMPLE 3

Additions to P/M Brasses

In order to evaluate the effectiveness of Bi additions to brass machineability characteristics, additions were made to both Non-leaded and Leaded brasses. All testing was done in accordance with the testing procedure mentioned earlier.

All test specimens in Table 4 were sintered at 1600° F. for a total time of 45 minutes in a dNH3 atmosphere.

TABLE 3

| Drilling time (in/min) | | | | | |
|---|---|---|---|---|---|
| | | % Bi | | | |
| Total | | 0 | .01 | .03 | .05 |
| 70/30 Brass | 7.3 g/cm | .25 | .43 | .53 | .45 |
| 85/15 Brass | 7.6 g/cm | .36 | .43 | .49 | .51 |
| 90/10 Brass | 7.8 g/cm | .30 | .25 | .66 | .61 |
| 70/30 Leaded Brass | 7.3 g/cm | 2.78 | 4.68 | .6 | 4.24 |
| 80/20 Leaded Brass | 7.6 g/cm | 3.46 | 4.80 | .53 | 3.00 |

EXAMPLE 4

A bronze powder containing 90% copper and 10% tin was provided with the further addition of 0.5% by weight on the weight of the copper tin, of bismuth. Selected additions of carbon graphite, coathylene lubricant, stearic acid or zinc stearate were added. Sintered test bars were prepared and then test drilled. The drilling time in inches per minute through a ¼ inch thick sintered bar of given density at a constant drill bit speed and a drill unit false free fall weight, i.e. no spring retainer or varying physical force.

All test data set out in the following table reflects test specimens pressed to a green density of 6.0 g/cm$^3$, and sintered at 1520° F. for a time of 15 minutes under a dissociated ammonia atmosphere (75% $H_2$, 25% $N_2$).

TABLE 4

| % GRAPHITE | % COATHYLENE | % STEARIC ACID | % ZINC STEARATE | DRILLING SPEED (IN MINS) |
|---|---|---|---|---|
| 0.00 | 0.00 | 0.00 | 0.75 | 5.4 |
| 0.00 | 0.50 | 0.25 | 0.00 | 5.0 |
| 0.10 | 0.00 | 0.00 | 0.75 | 11.6 |
| 0.10 | 0.50 | 0.25 | 0.00 | 10.1 |
| 0.30 | 0.00 | 0.00 | 0.75 | 18.8 |
| 0.30 | 0.50 | 0.25 | 0.00 | 15.3 |
| 0.50 | 0.00 | 0.00 | 0.75 | 17.1 |
| 0.50 | 0.50 | 0.25 | 0.00 | 32.8 |

A standard bronze composition comprising 90% elemental copper powder, 10% elemental tin powder, and 0.75% lubricant, had a drilling rate of 0.9 inches per minutes when processed under the same conditions. The above tests show significant increases in the drilling rate, up to 36 times the standard rate.

We claim:

1. A metallurgy powder for use in manufacturing a shaped brass part by powder metallurgy techniques, the powder consisting essentially of a substantially homogeneous blend of elemental and prealloyed metal powders having about 70–90 parts copper, about 10–30 parts zinc and an amount of bismuth in the range from an amount effective to improve the machinability of the shaped brass part up to about 5% weight, the powder being substantially free of lead.

2. The metallurgy powder of claim 1 wherein the bismuth is included as an elemental powder.

3. The metallurgy powder of claim 1 further consisting of a lubricant.

4. The metallurgy powder of claim 3 further consisting of a lubricant selected from the group consisting of graphite, low density polyalkylenes, stearic acid and zinc stearate.

5. The metallurgy powder of claim 1 further consisting of 0.1%–0.9% wt graphite.

6. A metallurgy powder for use in manufacturing a shaped brass part by powder metallurgy techniques, the powder consisting essentially of a substantially homogeneous blend of elemental or prealloyed metal powders having about 70–90 parts copper, about 10–30 parts zinc and an amount of bismuth in the range from an amount effective to improve the machinability of the shaped brass part up to about 5% weight, the powder being substantially free of lead.

7. The metallurgy powder of claim 6 wherein the bismuth is included as an elemental powder.

8. The metallurgy powder of claim 6 further consisting of a lubricant.

9. The metallurgy powder of claim 8 further consisting of a lubricant selected from the group consisting of graphite, low density polyalkylenes, stearic acid and zinc stearate.

10. The metallurgy powder of claim 6 further consisting of 0.1%–0.9% wt graphite.

11. A metallurgy powder for use in manufacturing a shaped bronze part by powder metallurgy techniques, the powder consisting essentially of a substantially homogeneous blend of elemental and prealloyed metal powders having about 90 parts copper, about 10 parts tin and an amount of bismuth in the range from an amount effective to improve the machinability of the shaped bronze part up to about 5% weight, the powder being substantially free of lead.

12. The metallurgy powder of claim 2 wherein the bismuth is included as an elemental powder.

13. The metallurgy powder of claim 2 further consisting of a lubricant.

14. The metallurgy powder of claim 3 further consisting of a lubricant selected from the group consisting of graphite, low density polyalkylenes, stearic acid and zinc stearate.

15. The metallurgy powder of claim 2 further consisting of 0.1% –0.9% wt graphite.

16. A metallurgy powder for use in manufacturing a shaped bronze part by powder metallurgy techniques, the powder consisting essentially of a substantially homogeneous blend of elemental or prealloyed metal powders having about 90 parts copper, about 10 parts tin and an amount of bismuth in the range from an amount effective to improve the machinability of the shaped bronze part up to about 5% weight, the powder being substantially free of lead.

17. The metallurgy powder of claim 16 wherein the bismuth is included as an elemental powder.

18. The metallurgy powder of claim 16 further consisting of a lubricant.

19. The metallurgy powder of claim 18 further consisting of a lubricant selected from the group consisting of graphite, low density polyalkylenes, stearic acid and zinc stearate.

20. The metallurgy powder of claim 16 further consisting of 0.1% –0.9% wt graphite.

* * * * *